US009819088B2

(12) United States Patent
Lai et al.

(10) Patent No.: US 9,819,088 B2
(45) Date of Patent: Nov. 14, 2017

(54) APERTURE-COUPLED MICROSTRIP-LINE FEED FOR CIRCULARLY POLARIZED PATCH ANTENNA

(71) Applicant: City University of Hong Kong, Kowloon (HK)

(72) Inventors: Hau Wah Lai, Kowloon (HK); Ka Ming Mak, Tseung Kwan O (HK); Kwai Man Luk, Kowloon (HK); Chi Hou Chan, Kowloon Tong (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 191 days.

(21) Appl. No.: 14/564,968

(22) Filed: Dec. 9, 2014

(65) Prior Publication Data

US 2016/0164182 A1 Jun. 9, 2016

(51) Int. Cl.

| | |
|---|---|
| ***H01Q 1/00*** | (2006.01) |
| ***H01Q 9/04*** | (2006.01) |
| ***H01Q 13/10*** | (2006.01) |
| ***H01Q 13/16*** | (2006.01) |
| ***H01Q 21/00*** | (2006.01) |
| ***H01Q 21/06*** | (2006.01) |
| ***H01Q 21/24*** | (2006.01) |

(52) U.S. Cl.

CPC ..... *H01Q 9/0428* (2013.01); *H01Q 13/106* (2013.01); *H01Q 13/16* (2013.01); *H01Q 21/0006* (2013.01); *H01Q 21/064* (2013.01); *H01Q 21/065* (2013.01); *H01Q 21/24* (2013.01)

(58) Field of Classification Search

CPC ..... H01Q 1/46; H01Q 21/064; H01Q 21/24; H01Q 21/065; H01Q 13/106; H01Q 21/0006; H01Q 13/16; H01Q 9/0428; H01Q 1/48; H01Q 1/50; H01Q 1/243; H04B 1/18

USPC ..... 343/700 MS, 905

See application file for complete search history.

(56) References Cited

U.S. PATENT DOCUMENTS

| | | | | |
|---|---|---|---|---|
| 7,064,714 | B2 | 6/2006 | Lafleur | |
| 2002/0149520 | A1 | 10/2002 | Laubner et al. | |
| 2005/0052321 | A1* | 3/2005 | Lee | H01Q 1/38 343/700 MS |
| 2011/0012788 | A1 | 1/2011 | Rowell et al. | |
| 2012/0019425 | A1 | 1/2012 | Lee et al. | |

* cited by examiner

*Primary Examiner* — Hoang Nguyen
*Assistant Examiner* — Jae Kim
(74) *Attorney, Agent, or Firm* — Amin, Turocy & Watson, LLP

(57) ABSTRACT

An aperture coupled, single fed, microstrip line feed for a circularly polarized patch antenna is provided that can transmit transmissions with a low profile, wide impedance, and axial ratio bandwidths. The circularly polarized patch antenna includes a double sided printed circuit board with a non-linear slots etched into a ground plane of one side of the printed circuit board, with a printed microstrip line printed on the opposite side of the printed circuit board. The microstrip line can be hook shaped and intersect each of the slots. The non linear slots can be radially arranged around a locus or area on the circuit board. A metal patch can placed above the ground plane and electromagnetic waves emanating from the microstrip line can couple to the patch through the non-linear strips and excite the patch such that it radiates an electromagnetic transmission.

16 Claims, 13 Drawing Sheets

400

700

702

704

706

708

1600

1602

Table 1. Low angle gain enhancement with different thickness of surrounded dielectric substrate

| Thickness of Surrounded Dielectric Substrate | 0mm | 1.5mm | 3mm | 4.5mm | 6mm |
|---|---|---|---|---|---|
| Gain at theta=50° (Enhancement when compared to the case at 0mm) | 2dBic | 2.56 dBic (+0.56) | 2.92 dBic (+0.92) | 3.2 dBic (+1.2) | 3.2 dBic (+1.2) |
| Gain at theta=70° (Enhancement when compared to the case at 0mm) | -1dBic | -0.2 dBic (+0.8) | 0.58 dBic (+1.58) | 0.61 dBic (+1.61) | 0.59 dBic (+1.61) |
| Gain at theta=80° (Enhancement when compared to the case at 0mm) | -3.17dBic | -1.67 dBic (+1.5) | -1.01 dBic (+2.16) | -1.06 dBic (+2.11) | -1.14 dBic (+2.03) |

Table 2. Low angle gain enhancement with different thickness of metallic block

| Thickness of Metallic Block | 0mm | 5mm | 10mm | 15mm | 20mm |
|---|---|---|---|---|---|
| Gain at theta=50° (Enhancement when compared to the case at 0mm) | 1.8dBic | 2.77 dBic (+0.97) | 2.99 dBic (+1.19) | 3.11 dBic (+1.31) | 3.01 dBic (+1.21) |
| Gain at theta=70° (Enhancement when compared to the case at 0mm) | -1.12dBic | -0.5 dBic (+0.62) | -0.16 dBic (+0.96) | 0.21 dBic (+1.33) | 0.53 dBic (+1.65) |
| Gain at theta=80° (Enhancement when compared to the case at 0mm) | -2.85dBic | -2.47 dBic (+0.36) | -2.12 dBic (+0.73) | -1.65 dBic (+1.2) | -1.15 dBic (+1.72) |

1604

FIG. 16

APERTURE-COUPLED MICROSTRIP-LINE FEED FOR CIRCULARLY POLARIZED PATCH ANTENNA

TECHNICAL FIELD

This disclosure relates generally to a single fed circularly polarized patch antenna that uses an aperture-coupled microstrip-line feed.

BACKGROUND

Circularly polarized patch antennas can generally be classified into two types, single-fed and multi-fed types. Single-fed types have a relatively simple structure, but the usable bandwidth has traditionally been narrow. Multi-fed circularly polarized patch antennas can have broader operating bandwidth, but can be more complicated as external circuitry is generally required.

SUMMARY

The following presents a simplified summary of the specification in order to provide a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later. It will also be appreciated that the detailed description may include additional or alternative embodiments beyond those described in this summary.

In various non-limiting embodiments, a circularly polarized patch antenna can include a metal patch and a ground plane with non-linear slots etched into the ground plane, wherein the non-linear slots are radially positioned around a locus of the ground plane and a top side of the ground plane is opposite the metal patch. The circularly polarized patch antenna can also include a microstrip line printed onto a circuit board around the locus and on a bottom side of the ground plane, wherein the microstrip line is underneath the non-linear slots.

In another embodiment, a method comprises receiving a transmission at a microstrip line printed on a first side of a dielectric substrate, wherein the microstrip line is printed around a position on the dielectric substrate. The method can also comprise coupling the transmission to a metal patch via non-linear slots etched into a ground plane on a second side of the dielectric substrate, wherein a portion of the transmission that couples to the metal patch via a non-linear slot of the non-linear slots is out of phase with respect to another portion of the transmission that couples to the metal patch via another non-linear slot.

In another example embodiment, a method for fabricating a circularly polarized patch antenna comprises printing a microstrip line onto a first side of a circuit board, wherein the microstrip line is configured to be communicably coupled to a feedport and is printed around an area of the circuit board. The method can also include etching non-linear slots into a ground plane on a second side of the circuit board, wherein the non-linear slots are radially positioned around the area of the circuit board and opposite the microstrip line. The method can also include forming a metal patch opposite the ground plane of the circuit board.

The following description and the annexed drawings set forth certain illustrative aspects of the specification. These aspects are indicative, however, of but a few of the various ways in which the principles of the specification may be employed. Other novel features of the specification will become apparent from the following detailed description of the specification when considered in conjunction with the drawings.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

FIG. 16 illustrates two tables showing low angle gain enhancement in accordance with various aspects and embodiments described herein.

DETAILED DESCRIPTION

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

As an overview of the various embodiments presented herein, an aperture coupled, single fed, microstrip line feed for a circularly polarized patch antenna with low profile, wide impedance, and axial ratio bandwidths is provided. The circularly polarized patch antenna includes a double sided printed circuit board with a non-linear slots etched into a copper ground plane of one side of the printed circuit board, with a printed microstrip line printed on the opposite side of the printed circuit board. The microstrip line can be hook shaped and intersect each of the slots. The non linear slots can be radially arranged around a locus or area on the circuit board. A metal patch can placed above the ground plane and electromagnetic waves emanating from the microstrip line can couple to the patch through the non-linear strips and excite the patch such that it radiates an electromagnetic transmission.

Gain at the boresight direction can be enhanced by placing a reflector at an optimized location below the antenna. The gain at low elevation angle can be increased by including a dielectric substrate (such as a foam layer) fully or partially encapsulating the patch of the antenna, and a metallic block at the back of the antenna. With this simple structure, the antenna is wide in both impedance and axial ratio bandwidth. The radiation patterns at different frequencies are very stable within the whole passband. The structure of the invented antenna can be modified to suit for different radiating requirements, such as low back radiation, miniature in size, wide in half power beamwidth or high gains at boresight or low elevation angles.

Figure 1:
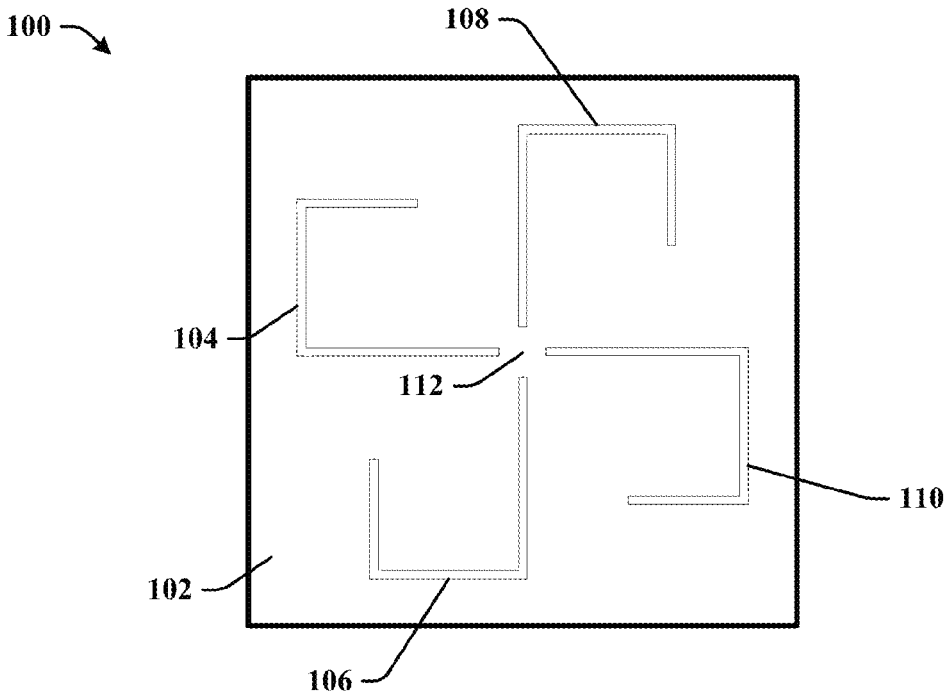
FIG. 1 illustrates an example embodiment of a ground plane with non linear slots in accordance with various aspects and embodiments described herein.

Turning now to FIG. 1, illustrates an example embodiment of a ground plane with non linear slots in accordance with the subject disclosure. Printed circuit board 100 can have a ground plane 102 with several non-linear slots 104, 106, 108, and 110 arranged radially around a locus/point/position 112. In some embodiments, the non-linear slots 104, 106, 108, and 110 can be radially symmetrical around locus 112, and in other embodiments, non-linear slots 104, 106, 108, and 110 can be arranged in non-symmetrical configurations. In an embodiment of the subject application, the non-linear slots 104, 106, 108, and 110 are not connected to each other.

The ground plane 102 can be an electrically conductive surface (e.g., copper) and can be connected to an electrical ground. In the embodiment shown in FIG. 1, the non-linear slots 104, 106, 108, and 110 can have three conjoined linear segments with each being at 90 degree angles relative to the attached linear segment, forming an Γ-shaped slot. In other embodiments, L-shaped slots are possible as well as curved C-shaped slots. In an embodiment, each of the non-linear slots 104, 106, 108, and 110 can be identical to each other with their orientation sequentially rotated about the center of the antenna by 0°, 90°, 180° and 270°, respectively. In an embodiment, the width of the slot can be around 1 mm, with the 3 segments of the slots 104, 106, 108, and 110 ($L_A$, $L_B$, and $L_C$) forming a total slot length roughly equal to 0.81λ, where λ is equal to a wavelength of the intended transmission. In an embodiment, the separation between the opposite slots at the closest point near the locus 112 can be 3 mm. In an embodiment, a length of an end of the square ground plane 102 have an edge length $G_L$=0.49λ.

Figure 2:
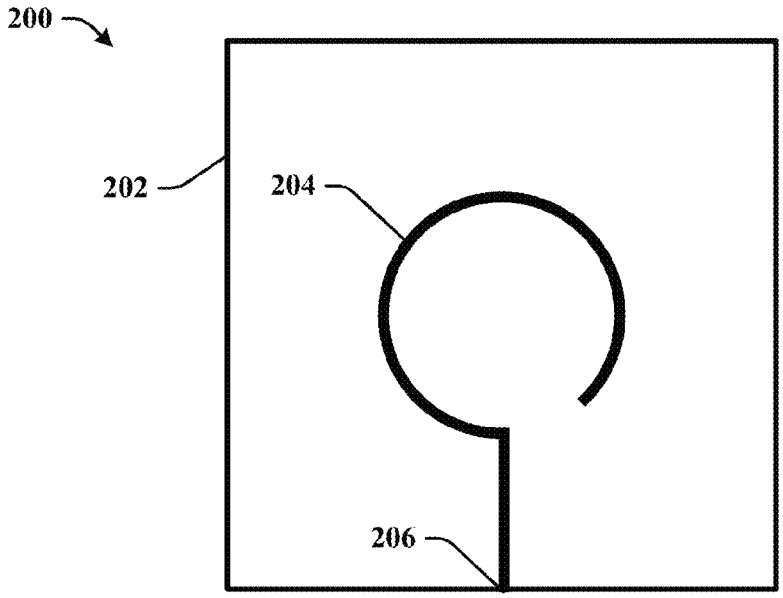
FIG. 2 illustrates an example embodiment of a microstrip line on a printed circuit board in accordance with various aspects and embodiments described herein.

Turning now to FIG. 2, illustrated is an example embodiment 200 of a microstrip line on a printed circuit board in accordance with various aspects and embodiments described herein. The printed circuit board 202 with the microstrip line 204 printed thereon in FIG. 2 is the reverse, or opposite side of the board 100 shown in FIG. 1. The hook-shaped microstrip line 204 can be printed on the printed circuit board 202 using traditional microstrip printing processes and methods. In an embodiment, a radius of the hook shaped portion of the microstrip line can be around 10.75 mm and the total length can be 70 mm, which is nearly one guided wavelength at the center frequency in the substrate. The width of the feed line 204 in the ring is $w_2$ (1.85 mm) and its line impedance is 63.5Ω. The open end of this hook-shaped section can be short-circuited to the ground plane. The beginning end of the hook-shaped feed line is connected to a 50 Ω SMA connector 206 which is the input port for the antenna. In other embodiments, the microstrip line 204 can be left open circuited or loaded in order to match the antenna.

In other embodiments, the microstrip line 204 can be other shapes including forming an ellipse, rhombus, square, oval, hexagonal, octagonal, etc. In an embodiment, the microstrip line 204 can make more than one revolution around the locus, wrapping two or more times. The microstrip line 204 can thus intersect each non-linear slot (e.g., slots 104, 106, 108, and 110) a plurality of times. Additionally, the microstrip line 204 can also vary in width from end to end of the microstrip line 204. In an embodiment, the width of the microstrip line 204 at the input end can be larger than the width of the microstrip line 204 at the end opposite the input end of the microstrip line 204.

Figure 3:
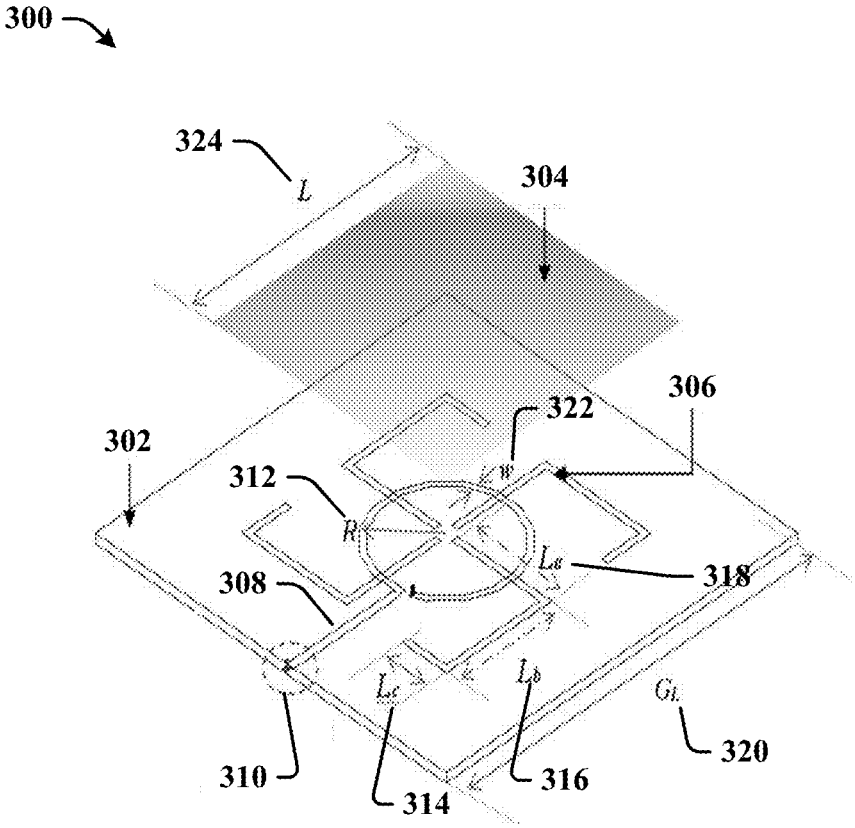
FIG. 3 illustrates the 3D view of an example embodiment of a circularly polarized patch antenna in accordance with various aspects and embodiments described herein.

Turning now to FIG. 3, illustrated is circularly polarized patch antenna 300 in accordance with various aspects and embodiments described herein. The embodiment shown in FIG. 3 shows a possible design for a circularly polarized antenna that has an intended frequency around 2.4 GHz. The antenna has a metal patch 304 and a double sided printed circuit board 302. The bottom side of the double sided printed circuit board 302 can have a printed microstrip line 308 that is connected to a 50 Ω SMA connector 310 which is the input port for the antenna 300. A radius R 312 of the hook shaped microstrip line can be around 10.75 mm and the total length can be 70 mm, which is nearly one guided wavelength at the center frequency in the substrate. The width of the feed line in the ring is w 322 which can be around 1.85 mm and its line impedance is 63.5Ω. The open end of this hook-shaped section can be short-circuited to the ground plane or left open circuited.

A electromagnetic transmissions from the microstrip line 308 couple through the non-linear slots (e.g., slot 306) to metal patch 304 which then radiates the transmissions. The top side of the double sided printed circuit board 302 can have a ground plane with 4 non linear slots (e.g., slot 306) etched into the ground plane. The non linear slot 306 can have 3 segments $L_A$ 318, $L_B$ 316, and $L_C$ 314 forming a total slot length roughly equal to 0.81λ, where λ is equal to a wavelength of the intended transmission. $L_A$ 318 can be 20 mm long, $L_B$ 316 can be 23.4 mm, and $L_C$ 314 can be 17.5 mm. Each of the non-linear slots can have three conjoined linear segments with each being at 90 degree angles relative to the attached linear segment, forming an Γ-shaped slot. In other embodiments, L-shaped slots with two segments are possible as well as curved C-shaped slots with one segment. In an embodiment, each of the non-linear slots can be identical to each other with their orientation sequentially rotated about the center of the antenna by 0°, 90°, 180° and 270°, respectively. The slots can also be radially symmetrical around the locus or center of the printed circuit board 302 in some embodiments, or can have a non-radially symmetrical distribution in other embodiments. In the non-radially symmetrical embodiments, the relative rotational orientation may be different from the angles 0°, 90°, 180° and 270° described above to reflect the non-radially symmetrical distribution. In an embodiment, the patch 304 can be metallic and have a length L 324=43.4 mm or $0.35\lambda_0$ while a length of a side of the Ground plane $G_L$ 320 can be 60 mm or $0.49\lambda_0$. The metal patch can also be at least one of a quadrilateral, circular, ellipsoid, ring, corner-truncated, or irregular shape.

Figure 4:
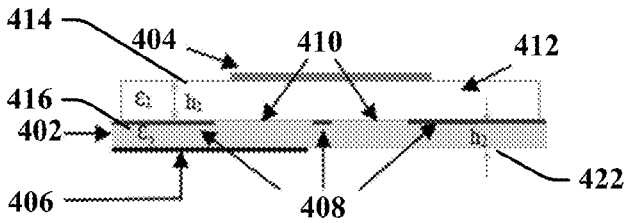
FIG. 4 illustrates the side view of an example embodiment of a circularly polarized patch antenna in accordance with various aspects and embodiments described herein.

Turning now to FIG. 4, illustrated is an example embodiment of a circularly polarized patch antenna 400 in accordance with various aspects and embodiments described herein. FIG. 4 shows patch antenna 400 at a side angle showing the layers. The bottom side of the printed circuit board 402 includes a microstrip line 406 that carries a signal which couples to a patch 404 through slots 410 in the ground plane 408 of the top side of the printed circuit board 402. In an embodiment, there can be a foam layer 412 separating the ground plane 408 from the patch 404. The foam layer 412 can have a thickness $h_1$ 414 of 0.09 $\lambda_0$ which is also equal to 11 mm. The thickness of the printed circuit board 402 can be $h_2$ 422=0.005 $\lambda_g$ which is also equal to 1 mm. The dielectric constant $\in_2$ 416 of the printed circuit board can equal 2.65 in an embodiment of the subject disclosure. It is to be appreciated that in other embodiments, the heights of the foam layer and printed circuit boards as well as the dielectric constants of the foam and PCB board can be different based on the frequency/wavelength of the designated/intended transmission, as well as the transmission characteristics desired (e.g., measured axial ratios, boresight gain, radiation patterns, etc.)

Figure 5:
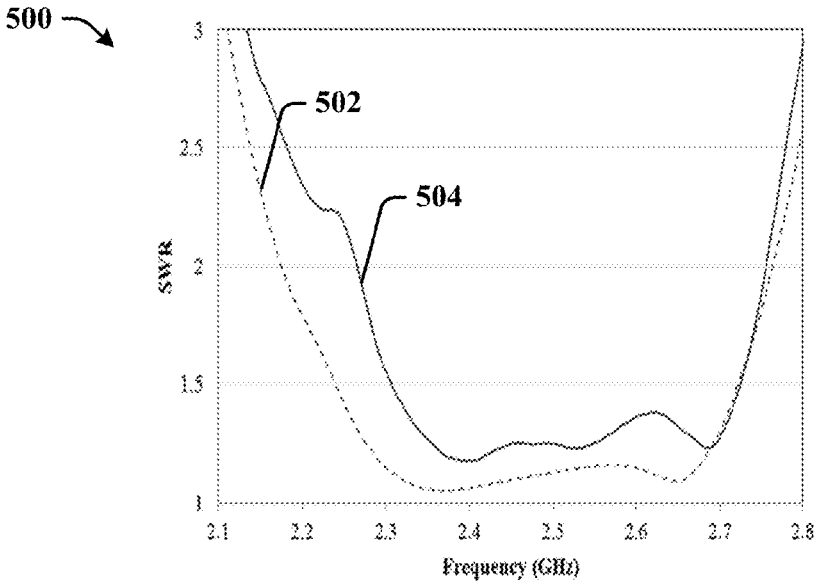
FIG. 5 illustrates a graph showing a simulated and a measured standing wave ratio (SWR) of a circularly polarized patch antenna in accordance with various aspects and embodiments described herein.

Turning now to FIG. 5, illustrated is a graph 500 showing the simulated and measured SWRs of a circularly polarized patch antenna in accordance with various aspects and embodiments described herein. The line 502 shows the simulated SWR and the line 504 shows the measured SWR. The graph shows standing wave ratio (SWR) plotted vs. the frequency. The antenna has a measured impedance bandwidth (with SWR less than 1.5) of 16.5%, from 2.31 to 2.73 GHz. The corresponding simulation is from 2.23 to 2.7 GHz, which is 19.1%.

Figure 6:
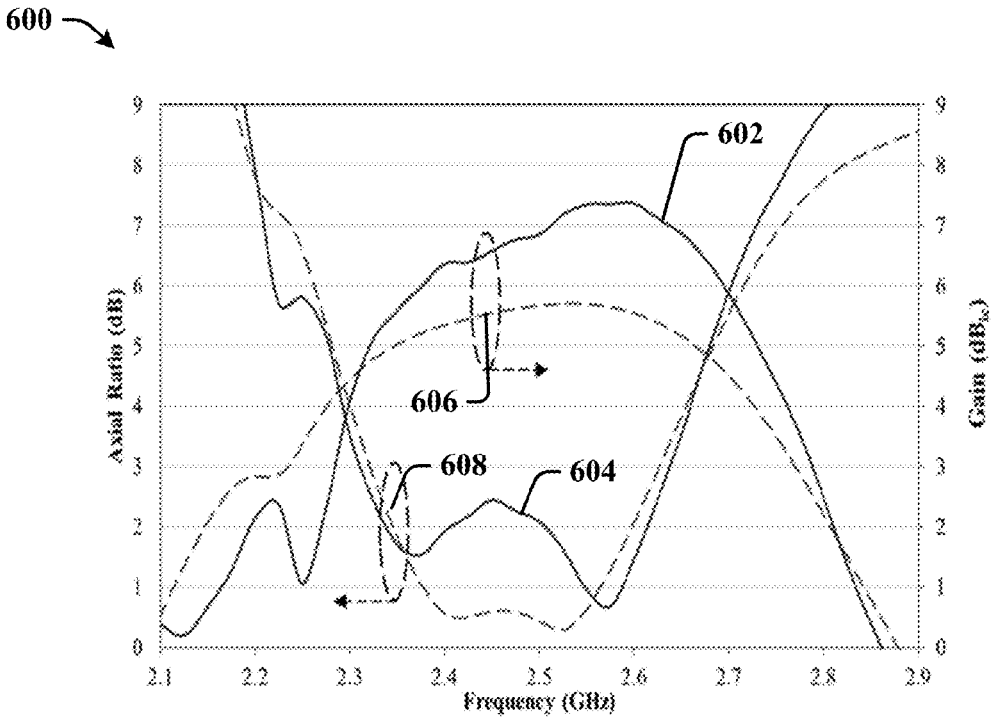
FIG. 6 illustrates a graph showing axial ratio and gain against frequency of a circularly polarized patch antenna in accordance with various aspects and embodiments described herein.

FIG. 6 shows a graph 600 showing simulated and measured axial ratio and gain against frequency of a circularly polarized patch antenna in accordance with various aspects and embodiments described herein. Lines 602 and 606 respectively show the measured and simulated gain, whereas lines 604 and 608 respectively show the measured and simulated axial ratio. The measured 3 dB axial ratio 604 bandwidth is about 13.3%, which is from 2.31 to 2.64 GHz, while the correspondence simulated 608 bandwidth is about 12.3%, which is from 2.322 to 2.627 GHz. The measured gain 602 in the boresight direction has a peak gain of 7.37 dB at 2.6 GHz and a gain around 6.5 dB within the frequency range. The corresponding results by simulation 606 are 5.8 dB at 2.52 GHz and around 5 dB.

The wide impedance and axial ratio bandwidths are achieved by this new feeding mechanism, which entails the use of a circular microstrip line coupling through four Γ-shaped slots to generate four sequentially phased sources to excite a patch antenna.

Figure 7:
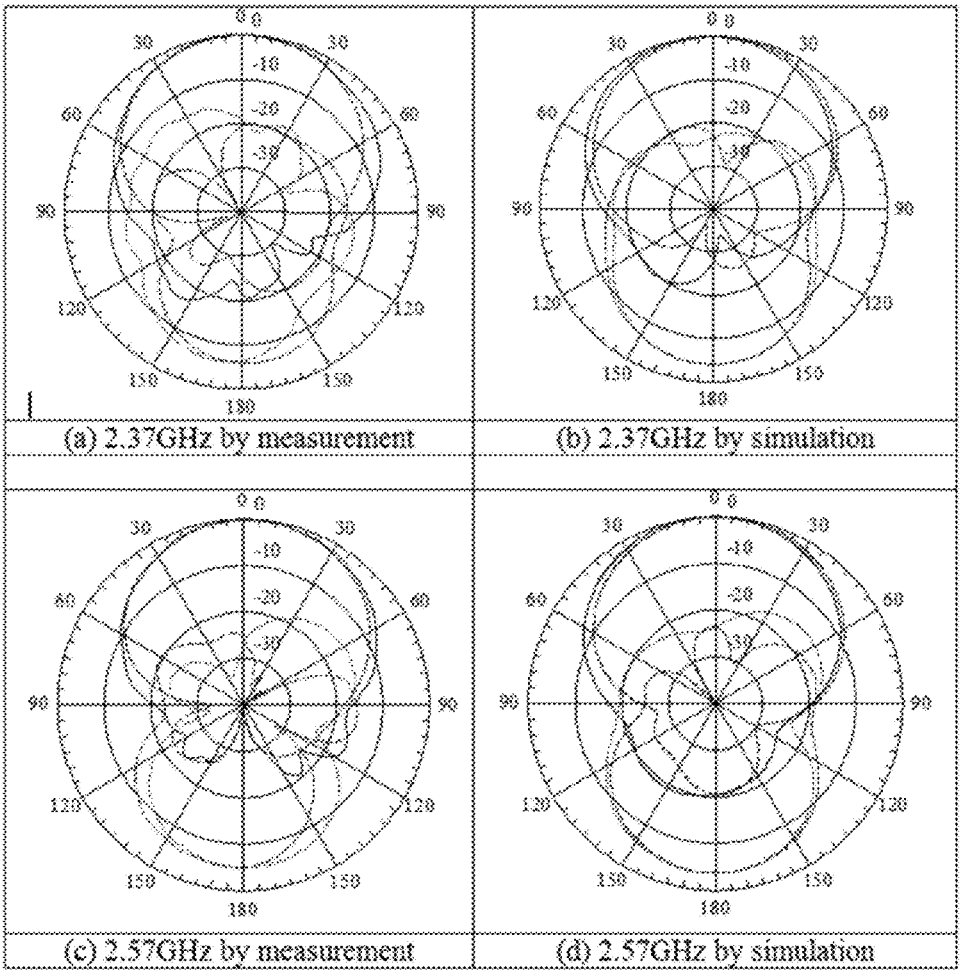
FIG. 7 illustrates a graph showing simulated and measured radiation patterns of a circularly polarized patch antenna in accordance with various aspects and embodiments described herein.

Turning now to FIG. 7 illustrated is a graph 700 showing simulated and measured radiation patterns of a circularly polarized patch antenna in accordance with various aspects and embodiments described herein. Each of the graphs 702, 704, 706, and 708 show a variety of simulated and measured radiation patterns (e.g., left handed circular polarization at phi=0° and 90° and right handed circular polarization at phi=0° and 90°) at 2.37 GHz and 2.57 GHz. 702 shows measured radiation patterns for 2.37 GHz, 704 shows simulated radiation patterns for 2.37 GHz, 706 shows measured radiation patterns for 2.57 GHz, and 708 shows simulated radiation patterns for 2.57 GHz. At 2.37 GHz the difference between RHCP and LHCP by measurement (702) and simulation (704) are 15 dB and 20 dB, respectively, within the half-power beamwidth of the radiation pattern, and are 20 dB and 22 dB, respectively, in the boresight direction. The antenna has a 3 dB beamwidth of about 77° at phi=0° plane and about 71° at phi=90° plane by measurement. The correspondence simulated results are 76° and 74°, respectively. The front-to-back ratio of the antenna at this frequency is about 6 dB by measurement and 5 dB by simulation.

As for the radiation patterns in 706, the measured RHCP radiation is less than the LHCP radiation by 25 dB in the boresight direction. The radiation patterns of the RHCP by simulation in 708 and experiment are almost the same at phi=0° and phi=90° plane. The antenna has a measured 3 dB beamwidth of about 72° at phi=0° plane and about 69° at phi=90° plane with the simulated beamwidth results of 71° and 69°, respectively. The percentage difference between measurement and simulation is below 4%, which is the same as the result obtained at 2.37 GHz. Both of the measured and simulated front-to-back ratios of the antenna at this frequency can be about 5 dB.

Figure 8:
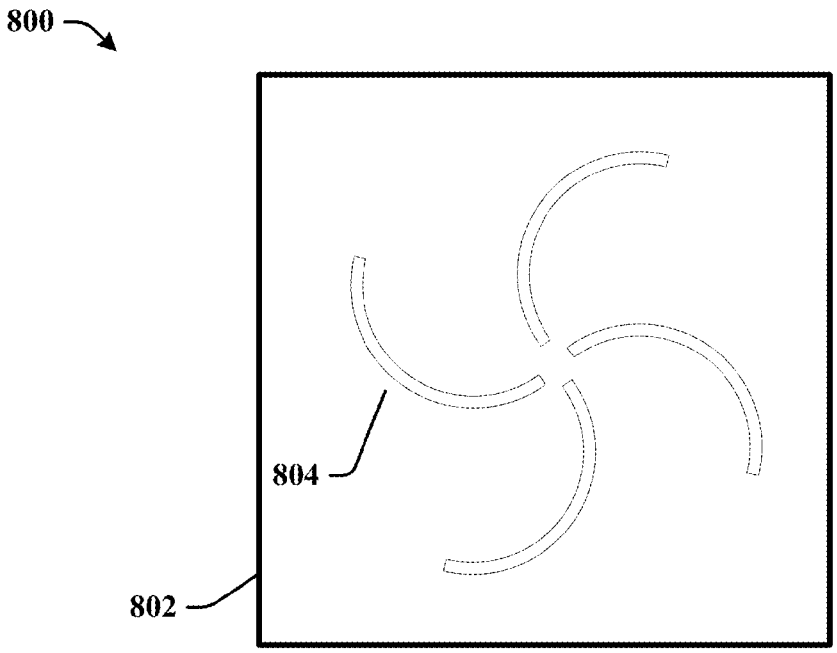
FIG. 8 illustrates an example embodiment of a ground plane with curved non linear slots in accordance with various aspects and embodiments described herein.

Turning now to FIG. 8, illustrated is an example embodiment 800 of a ground plane 802 with curved non linear slots 804 in accordance with various aspects and embodiments described herein. In an embodiment, the non-linear slots can be curved in the shape of a "C". In other embodiments, the slots 804 can be curved in a "S" shape. In other embodiments, L-shaped slots with two segments are possible as well. In an embodiment, each of the non-linear slots can be identical to each other with their orientation sequentially rotated about the center of the antenna by 0°, 90°, 180° and 270°, respectively.

Figure 9A:
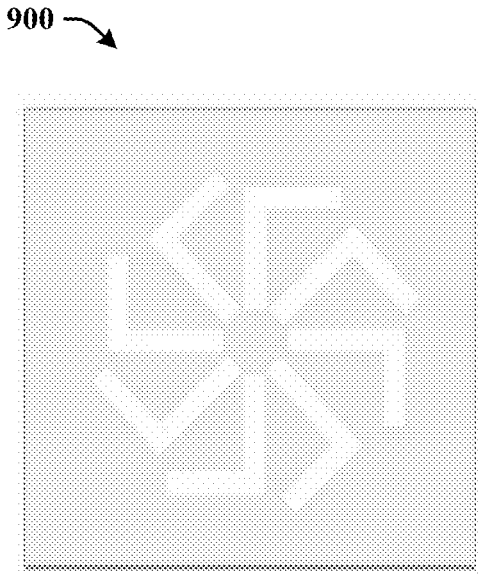
FIGS. 9A and 9B illustrate example embodiment of non-linear slots with a variety of distribution patterns in accordance with various aspects and embodiments described herein.
Figure 9B:
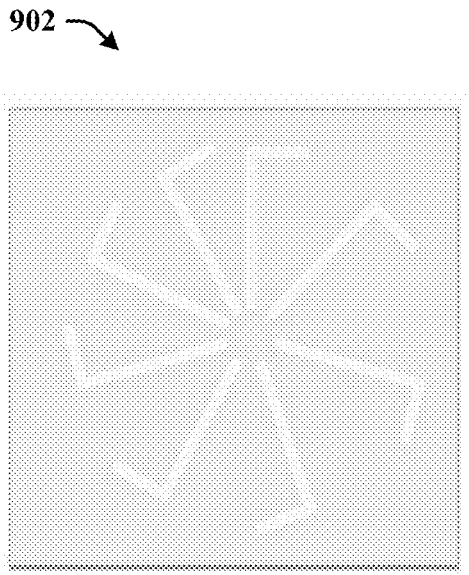

Turning now to FIGS. 9A and 9B, illustrated are example embodiments 900 and 902 of non-linear slots with a variety of distribution patterns in accordance with various aspects and embodiments described herein. In the distribution 900 shown in FIG. 9A, the slots are distributed radially symmetrical around the locus or center of the ground plane. In FIG. 9B, the slots are not radially symmetrically distributed, and have a denser distribution on the top than on the bottom. It is to be appreciated also that there can be a more than 4 non-linear slots in some embodiments. In fact, more identical slots can be loaded on the feeding substrate as long as the phase difference between each slot is sequentially distributed.

Figure 10:
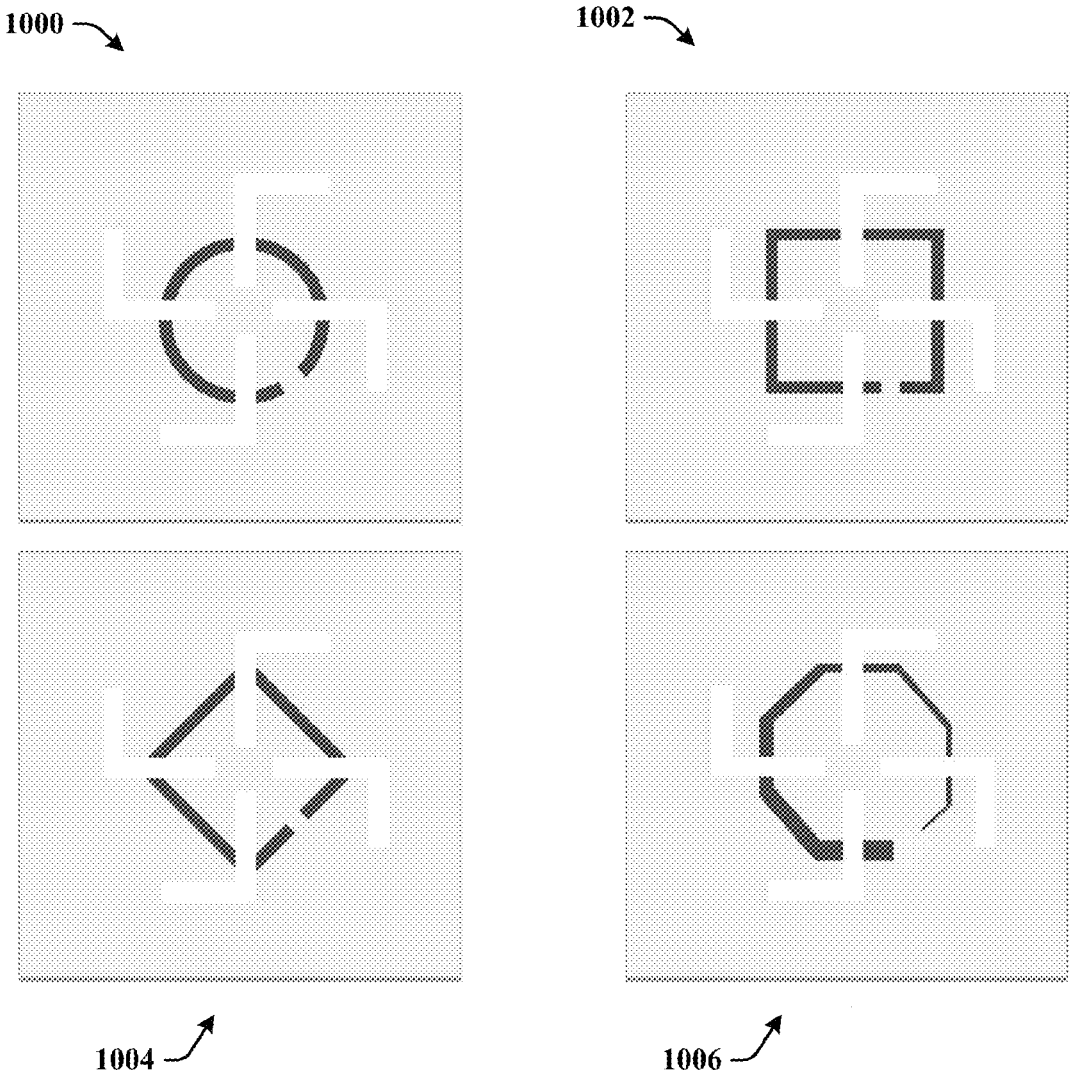
FIG. 10 illustrates an example embodiment of non-linear slots superimposed over several variations of microstrip lines in accordance with various aspects and embodiments described herein.

Turning now to FIG. 10, illustrated is an example embodiment of non-linear slots superimposed over several variations of microstrip lines in accordance with various aspects and embodiments described herein. FIG. 10 shows several variations showing circular (e.g., 1000) rhomboid (e.g., 1004), square (e.g., 1002), and octagonal (e.g., 1006) microstrip lines. Each of these different variations can be used for circularly polarized patch antennas that require different transmission characteristics.

In an embodiment, the microstrip lines can make more than one revolution around the locus, wrapping two or more times. The microstrip lines can thus intersect each non-linear slot a plurality of times. Additionally, the microstrip lines can also vary in width from end to end of the microstrip line (e.g., 1006). In an embodiment, the width of the microstrip line at the input end can be larger than the width of the microstrip line at the end opposite the input end of the microstrip line or vice versa.

Figure 11:
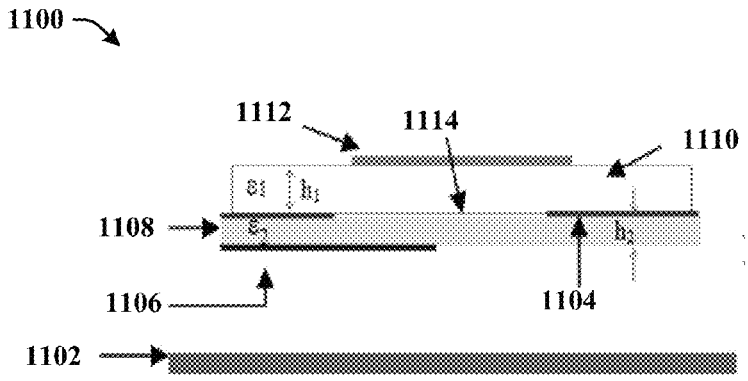
FIG. 11 illustrates the side view of an example embodiment of a circularly polarized patch antenna with a reflector in accordance with various aspects and embodiments described herein.

Turning now to FIG. 11, illustrated is an example embodiment of a circularly polarized patch antenna 1100 in accordance with various aspects and embodiments described herein. FIG. 11 shows patch antenna 1100 at a side angle showing the layers. The bottom side of the printed circuit board 1108 includes a microstrip line 1106 that carries a signal which couples to a patch 1112 through slots 1114 in the ground plane 1104 of the top side of the printed circuit board 1108. In an embodiment, there can be a foam layer 1110 separating the ground plane 1104 from the patch 1112.

If higher gain or back lobe suppression is required, a reflector 1102 can be placed at the back of the antenna, 1100. The length of the square reflector 1102 ($R_L$) and the separation between the antenna and reflector ($R_S$) are two critical parameters to be optimized. If the front-to-back ratio is 20 dB within the 3 dB axial ratio bandwidth, the optimized values of $R_L$ and $R_S$ can be 80 mm (0.66 wavelength in air) and 25 mm (0.2 wavelength in air), respectively.

Figure 12A:
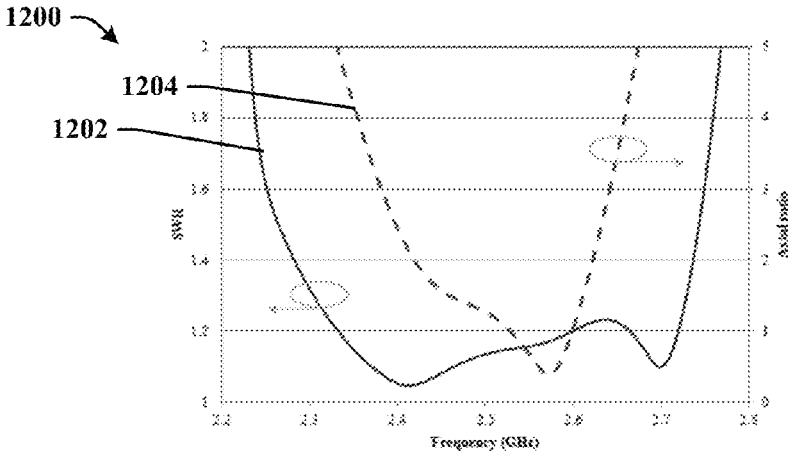
FIG. 12*a* illustrates a graph showing simulated standing wave ratio and axial ratio of a circularly polarized patch antenna in accordance with various aspects and embodiments described herein.
Figure 12B:
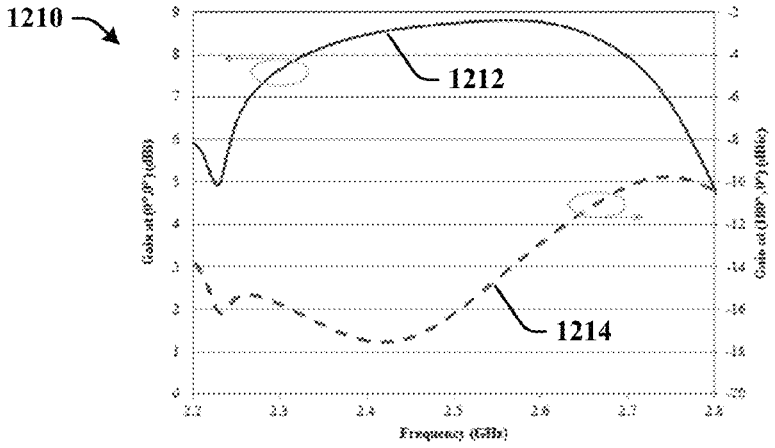
FIG. 12*b* illustrates a graph showing simulated gain against frequency of a circularly polarized patch antenna in accordance with various aspects and embodiments described herein.

Turning now to FIGS. 12A and 12B, illustrated are graphs showing measured standing wave ratio, axial ratio and simulated gain against frequency respectively of a circularly polarized patch antenna in accordance with various aspects and embodiments described herein.

1200 depicts measured standing wave ratio 1202 and axial ratio 1204 of the corresponding antenna 1100 with a reflector when $R_S$=25 mm and $R_L$=80 mm. It is observed that the wide impedance and axial ratio bandwidth characteristics remain unchanged, which are 21% and 10.5% respectively. The reflector can also increase the gain of the antenna.

1210 shows the gain against frequency when $R_S$=25 mm and $R_L$=80 mm at both (0°, 0°) 1212, and (180°, 0°) 1214. The simulated average gain of the antenna across its operating bandwidth is increased from about 5.5 dBic to about 8.5 dBic, which is a 3 dB enhancement over the antenna without a reflector. The simulated radiation patterns of the antenna with the reflector are very stable and the back radiations are below −20 dB for all angles. The cross polarization levels at boresight and within the 3 dB beamwidth are below −16 dB across the operating bandwidth. The circularly polarized patch antenna disclosed herein can be designed for a small size circularly polarized antenna, which is capable of providing high radiation gain both at the zenith and at low angle.

Figure 13:
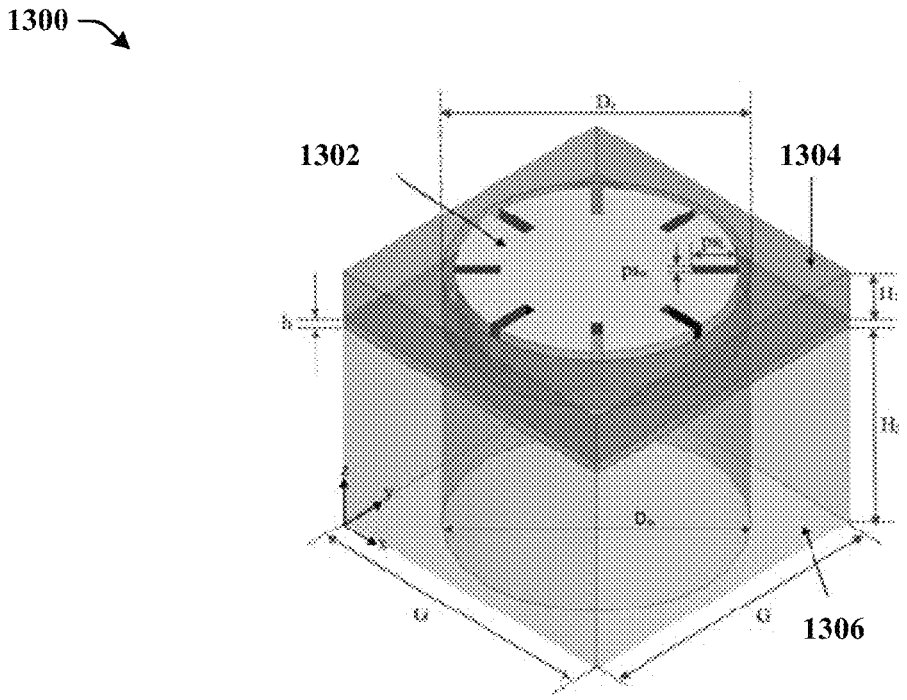
FIG. 13 illustrates the 3D view of an example embodiment of a miniaturized circularly polarized patch antenna in accordance with various aspects and embodiments described herein.

Turning now to FIG. 13, illustrated is an example embodiment of a miniaturized circularly polarized patch antenna 1300 in accordance with various aspects and embodiments described herein. FIG. 13 shows the typical miniature antenna design in circular polarization. The antenna 1300 is composed of a slotted hat shape patch 1302, a double sided printed-circuit-board (PCB), a metallic block 1306 and a surrounded dielectric substrate 1304. The radiating element, a circular hat-shaped folded patch 1302, is placed above the feed substrate and eight slots are loaded in the hat-shaped patch 1302. In this typical miniature design, all slots are identical and each slot is separated from its adjacent slot by an angle of 45° with respect to the center of the patch 1302. Above the double-sided PCB, the circular hat-shaped patch 1302 is surrounded by a dielectric substrate 1304. They are separated by a ring shape slot with a width of 1 mm. Without the hat-shaped patch 1302, a cylindrical air cavity is at the center of the surrounded substrate. Below the PCB, a metallic block 1306 is attached. Similar to the surrounded dielectric substrate 1304, a cylindrical hole is formed at the center of the metallic block 1306. The metallic block 1306 may be electrically connected or disconnected to the ground plane. The metallic block 1306 can be in different shapes, for example, rectangular, circular or tapered.

Some applications, such as Global Positioning System (GPS) and Satellite Personal Communication Network, require the size of antennas in the handheld device to be as compact as possible and the radiation patterns of the antenna 1300 should cover the complete azimuth range and wide range of elevation angles, such that the communication channel can be established as easily as possible to track the satellite.

The effective current path of the antenna can be increased by folding the patch 1302 and cutting slots on the patch and hence the resonance of a patch antenna 1300 is able to be shifted down to a lower frequency. There can be any number of slots on the patch as long as they are distributed symmetrically around the patch 1302.

The present invention also provides an improved antenna capable of providing high gain both at the zenith and at low elevation angle. Particularly, the antenna of the present invention includes a dielectric substrate 1304 fully or partially encapsulating the patch 1302 of the antenna, and a metallic block 1306 attached at the back of the antenna. The electromagnetic waves transmitted to and received from the patch 1302 can be refracted by the dielectric substrate 1304; thus the half power beamwidth and the gain at low angles can be increased. Adding a metallic block 1306 at the back of the antenna 1300 can change the current flowing on the ground. Extra current will be generated on the vertical parts of the metallic block and more energy concentrates at the lower angle of the antenna. Therefore, the gain at boresight can be reduced but the gain can be increased at the low elevation angles.

Figure 14:
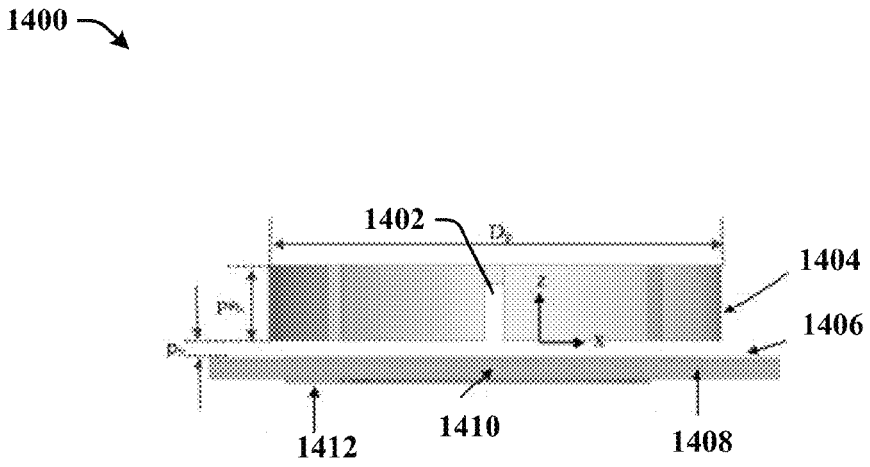
FIG. 14 illustrates the side view of an example embodiment of a miniaturized circularly polarized patch antenna in accordance with various aspects and embodiments described herein.

FIG. 14 shows another view of the antenna 1300 shown in FIG. 13. Metal patch 1404 includes a slot 1402 with a slotted ground plane 1406. The dielectric substrate 1408 can include a feed point 1410 that feeds a microstrip line 1412.

The measured impedance bandwidth of the antenna 1300 can be 11.08% (VSWR<2), with a passband from 3.58 to 4.00 GHz. The corresponding simulated bandwidth is 12.73%, which is between 3.53 and 4.01 GHz. The simulated 3 dB axial ratio bandwidth yields 3.44% (from 3.715 to 3.845 GHz). The corresponding measured bandwidth is 3.05% (from 3.715 to 3.83 GHz). The optimized axial ratio of the typical miniature design is 1.15 dB and appears at 3.77 GHz. Within the frequency range of the 3 dB axial ratio bandwidth, the measured gain is about 5 dBic with 0.2 dB variation; while the simulated gain is about 0.5 dB higher than the measurement.

Figure 15:
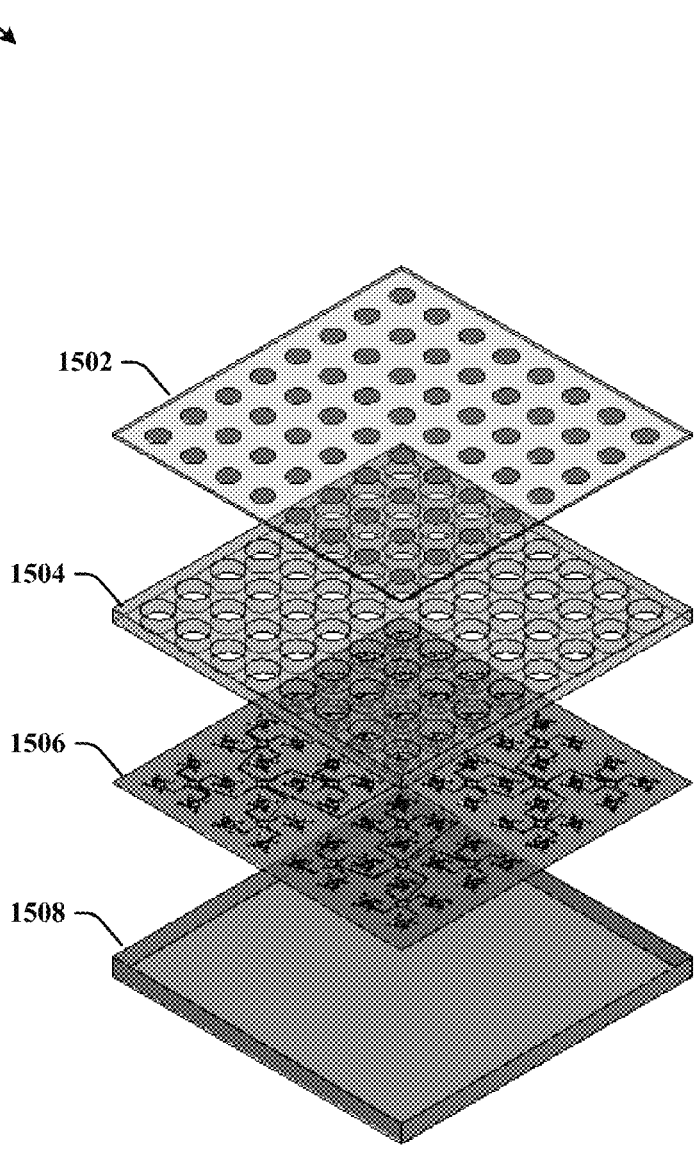
FIG. 15 illustrates an example embodiment of an array of circularly polarized patch antennas in accordance with various aspects and embodiments described herein.

FIG. 15 illustrates an example embodiment of an array of circularly polarized patch antennas in accordance with various aspects and embodiments described herein. The array 1500 of patch antennas shown in FIG. 15 can include 64 elements. 1502 shows the perspective layer of the printed circuit board with an array of patches. 1504 shows a layer that comprises a dielectric substrate ring, and 1506 comprises a ground plane with a microstrip feed line network. 1508 is a reflector with a vertical wall.

The tables in FIG. 16 demonstrate that high gain can be achieved at low elevation angle by surrounding the antenna with dielectric substrate and placing a metallic ring at the back of antenna. Table 1602 shows low angle gain enhancement with different thicknesses of surrounded dielectric substrate. Table 1604 shows low angle gain enhancement with different thicknesses of metallic block.

Figure 17:
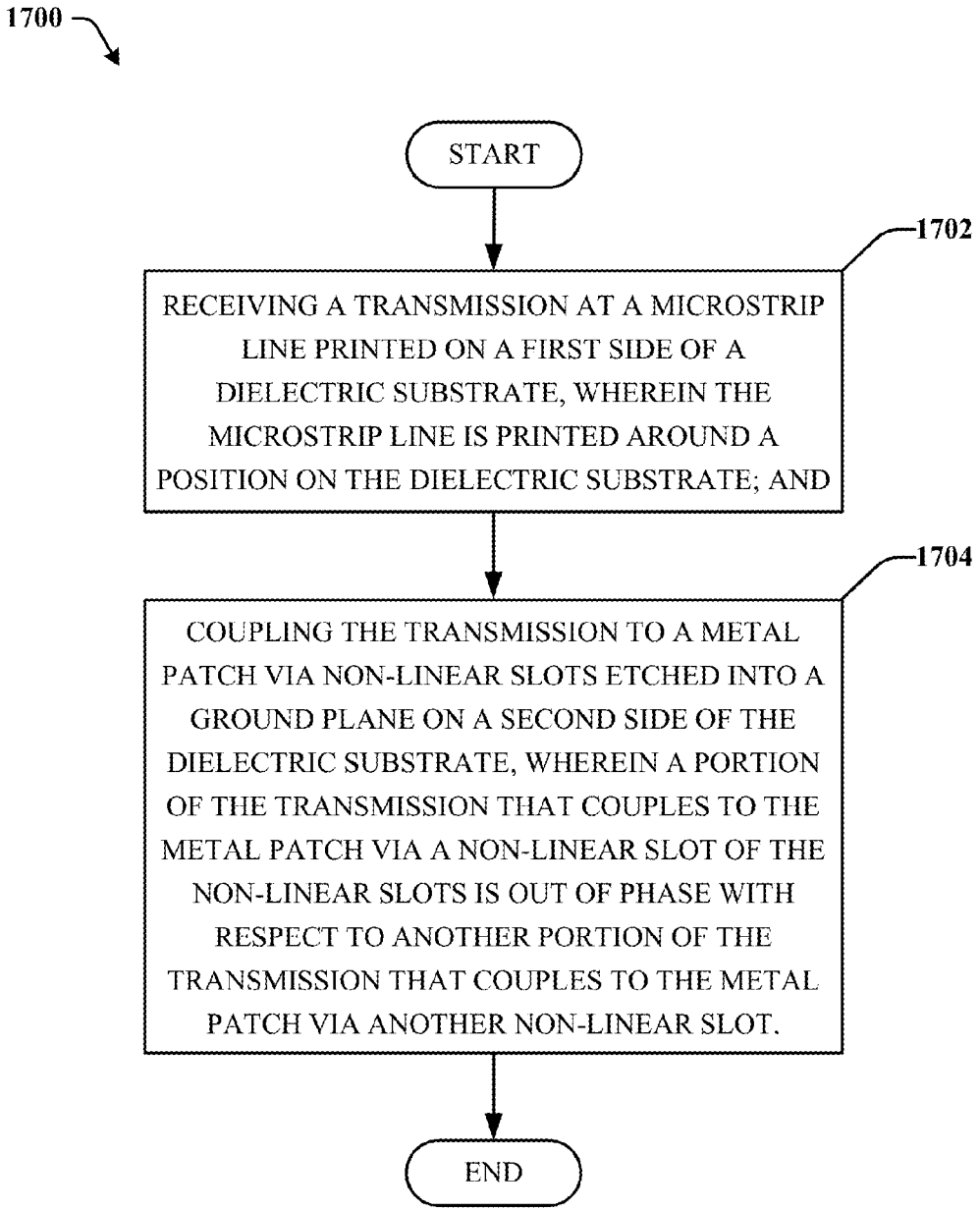
FIG. 17 illustrates a method for transmitting a circularly polarized transmission via a patch antenna in accordance with various aspects and embodiments.
Figure 18:
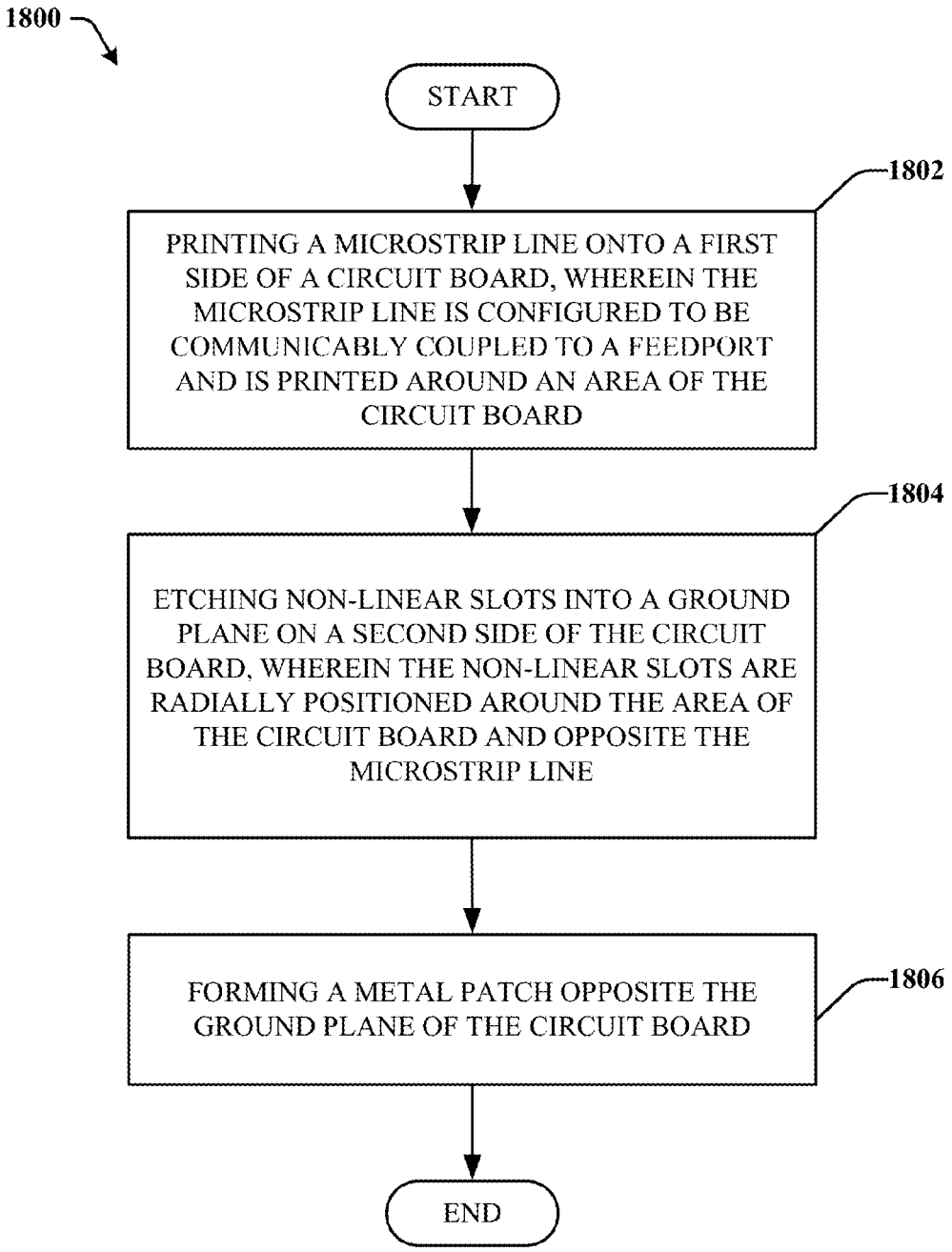
FIG. 18 illustrates a method for fabricating a circularly polarized patch antenna in accordance with various aspects and embodiments.

FIGS. 17-18 illustrate processes in connection with the aforementioned systems. The processes in FIG. 17-18 can be implemented for example by the embodiments shown in FIGS. 1-16. While for purposes of simplicity of explanation, the methods are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described hereinafter.

FIG. 17 illustrates an example, non-limiting method 1700 for transmitting a circularly polarized transmission via a patch antenna in accordance with various aspects and embodiments. Method 1700 can start at 1702 where a transmission is received at a microstrip line printed on a first side of a dielectric substrate, wherein the microstrip line is printed around a position on the dielectric substrate. At 1704, the methods includes coupling the transmission to a metal patch via non-linear slots etched into a ground plane on a second side of the dielectric substrate, wherein a portion of the transmission that couples to the metal patch via a non-linear slot of the non-linear slots is out of phase with respect to another portion of the transmission that couples to the metal patch via another non-linear slot.

FIG. 18 illustrates a method 1800 for fabricating a circularly polarized patch antenna in accordance with various aspects and embodiments. Method 1800 can begin at 1802 where a microstrip line is printed onto a first side of a circuit board, wherein the microstrip line is configured to be communicably coupled to a feedport and is printed around an area of the circuit board.

At 1804, non-linear slots can be etched into a ground plane on a second side of the circuit board, wherein the non-linear slots are radially positioned around the area of the circuit board and opposite the microstrip line. At 1806, a metal patch can be formed opposite the ground plane of the circuit board.

It is to be appreciated that while reference is generally made throughout the specification to the patch antenna transmitting transmissions, the patch antennas disclosed herein can also receive circularly polarized transmissions.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

Further, these components can execute from various computer readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the subject disclosure have been described herein for purposes of illustration, and that various modifications may be made without departing from the scope and spirit of the subject disclosure. Accordingly, the various embodiments disclosed herein are not intended to be limiting, with the true scope and spirit being indicated by the following claims.

What is claimed is:

1. A circularly polarized patch antenna, comprising:

a metal patch;

a ground plane with slots etched into the ground plane, wherein the slots are radially positioned around a locus of the ground plane and a top side of the ground plane is opposite the metal patch, wherein each slot of the slots has three linear segments, with a first linear segment radiating out from the locus, a second linear segment, connected to the first linear segment at a first right angle to the first linear segment, and a third linear segment joined to the second linear segment at a second right angle to the second linear segment, and wherein the third linear segment extends in a same direction as an origin of the first linear segment; and a hook shaped microstrip line printed onto a circuit board around the locus and on a bottom side of the ground plane, wherein the microstrip line is underneath the slots.

2. The circularly polarized patch antenna of claim 1, further comprising:

a substrate layer between the metal patch and the ground plane.

3. The circularly polarized patch antenna of claim 1, further comprising an air layer between the ground plane and the metal patch.

4. The circularly polarized patch antenna of claim 1, wherein the first linear segment and the third linear segment are about 3 mm apart.

5. The circularly polarized patch antenna of claim 1, wherein an end of the microstrip line opposite a feed is open circuited.

6. The circularly polarized patch antenna of claim 1, wherein an end of the microstrip line, opposite a feed, is short circuited to the ground plane.

7. The circularly polarized patch antenna of claim 1, wherein the slots are positioned radially symmetrically around the locus.

8. The circularly polarized patch antenna of claim 1, wherein the slots are positioned non-symmetrically around the locus.

9. The circularly polarized patch antenna of claim 1, wherein a width of the slots is about 1 mm.

10. The circularly polarized patch antenna of claim 1, wherein a length of the microstrip line is substantially equal to a wavelength of a guided wave associated with the circularly polarized patch antenna.

11. The circularly polarized patch antenna of claim 1, wherein the microstrip line forms more than one turn around the locus.

12. The circularly polarized patch antenna of claim 1, wherein the metal patch is at least one of a quadrilateral, circular, ellipsoid, ring, corner-truncated, or irregular shape.

13. A circularly polarized patch antenna, comprising:

a metal patch;

a ground plane with four slots etched into the ground plane, wherein the four slots are radially positioned around a locus of the ground plane and a top side of the ground plane is opposite the metal patch, wherein each slot of the four slots has three linear segments, with a first linear segment extending out from the locus, a second linear segment, connected to the first linear segment at a first right angle to the first linear segment, and a third linear segment joined to the second linear segment at a second right angle to the second linear segment, and wherein the second right angle is symmetrical to the first right angle across a plane normal to the second linear segment; and a hook shaped microstrip line printed onto a circuit board around the locus and on a bottom side of the ground plane, wherein the microstrip line is underneath the slots and wherein the microstrip line is configured to generate four sequentially phased sources corresponding to each of the four slots in response to the microstrip line being activated.

14. The circularly polarized patch antenna of claim 13, wherein an end of the microstrip line opposite a feed is open circuited.

15. The circularly polarized patch antenna of claim 13, wherein an end of the microstrip line, opposite a feed, is short circuited to the ground plane.

16. The circularly polarized patch antenna of claim 13, wherein a length of the microstrip line is substantially equal to a wavelength of a guided wave associated with the circularly polarized patch antenna.

* * * * *